US007267058B2

(12) United States Patent
Ohashi et al.

(10) Patent No.: US 7,267,058 B2
(45) Date of Patent: Sep. 11, 2007

(54) ARTICULATED TRUCK

(75) Inventors: Yoshikazu Ohashi, Hyogo (JP); Naohiro Hiraoka, Hyogo (JP); Keisuke Takahashi, Hyogo (JP); Yoichi Kishi, Hyogo (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 173 days.

(21) Appl. No.: 10/517,016

(22) PCT Filed: Jun. 10, 2003

(86) PCT No.: PCT/JP03/07307

§ 371 (c)(1),
(2), (4) Date: Dec. 3, 2004

(87) PCT Pub. No.: WO03/106239

PCT Pub. Date: Dec. 24, 2003

(65) Prior Publication Data

US 2005/0211127 A1 Sep. 29, 2005

(30) Foreign Application Priority Data

Jun. 13, 2002 (JP) ..... 2002-172460
Dec. 17, 2002 (JP) ..... 2002-365065

(51) Int. Cl.
*B61D 17/00* (2006.01)

(52) U.S. Cl. ..... 105/4.1; 105/157.1; 105/182.1; 105/206.1

(58) Field of Classification Search ..... 213/1.3, 213/1.6, 75 GT, 76; 105/3, 4.1, 4.2, 4.3, 105/4.4, 159, 157.1, 182.1, 206.1
See application file for complete search history.

(56) References Cited

U.S. PATENT DOCUMENTS 1,681,659 A 8/1928 Clarke et al.
2,036,535 A * 4/1936 Nelson ..... 414/800

FOREIGN PATENT DOCUMENTS

JP 17-3891 Y1 3/1942
JP 59-102564 7/1984

OTHER PUBLICATIONS

International Search Report for International Patent Application PCT/JP03/07307 dated Aug. 8, 2003 b the Japanese Patent Office.

* cited by examiner

*Primary Examiner*—Mark T. Le
(74) *Attorney, Agent, or Firm*—Marshall, Gerstein & Borun LLP

(57) ABSTRACT

Wires (electric wires) 29 and 30 of cars are connected to each other through connecting wires mounted to a truck frame of an articulated truck. The connecting wires are inserted into a flexible protecting pipe member and an intermediate portion thereof is mounted within a concave portion formed on an upper portion of a side frame of the truck frame. And, an upper opening of the concave portion is closed by a cover plate. Connectors 22 and 23 are provided at front and rear end portions of the connecting wire for electric connection with cars. The connectors 22 and 23 are removably connected to connectors 26 and 27 of the wires 29 and 30 of the cars, which are mounted by mounting brackets 24 and 25 under the car bodies 2A and 3A.

4 Claims, 11 Drawing Sheets

ARTICULATED TRUCK

TECHNICAL FIELD

The present invention relates to an articulated truck mounted between two cars.

BACKGROUND ART

In railway vehicles, it is known that a train is equipped with an articulated truck between two cars thereof in view of cost reduction, and improved running stability for comfortable ride-in, etc. As shown in FIG. 8, in a case where the train (train set) is constituted by mounting an articulated truck 101 between a car 102 and a car 103, the articulated truck 101 is positioned in a space under the cars. Wires 104 connecting the cars 102 and 103 cannot sag down under a restriction of a space because of the presence of the articulated truck 101. For this reason, in general, car body ends of the cars are recessed to form spaces (concave portions) 102*a* and 103*a*, and the wires 104 are provided between them above the articulated truck 101.

In the case of a train which is not equipped with the above articulated truck, crossovers of railway cars sag down on rail side between connecting portions formed at end portions of car bodies of cars coupled by couplers (for example, see Japanese Utility Model Application Publication Hei. No. 6-37045).

In the former construction, since the car body ends are recessed to form the spaces (concave portions) 102*a* and 103*a*, an effective space within a passenger's cabin is reduced and a structure of the car body becomes intricate. In the construction in which the wires are provided above the articulated truck 101, a car body structure becomes intricate with an increase in the number of components, and a center of gravity of the car body is located higher than that of the train which is not equipped with the articulated truck. This is disadvantageous to the running stability and is undesirable to car performance.

In the latter construction, it is necessary to provide a protecting plate for protecting the crossovers connecting the connecting portions of the railway vehicle under the crossovers in order to inhibit damage to the crossovers.

In the case of the train equipped with the articulated truck, the same problem arises, when pipes (e.g., air pipes) for control driving or braking are provided between the cars, in addition to the wires.

DISCLOSURE OF THE INVENTION

The present invention has been developed under the circumstances, and an object of the present invention is to provide an articulated truck which allows wire connection and pipe connection between cars to be easily achieved.

According to one aspect, the invention is an articulated truck mounted between two cars, comprising a connecting wire or a connecting pipe configured to interconnect wires or pipes of two cars which are disposed under floors of the two cars; and a truck frame of the articulated truck, wherein the connecting wire or the connecting pipe is mounted to the truck frame. As defined herein, "mounted to the truck frame" means "mounted directly or indirectly to the truck frame."

In such a construction, the wires or the pipes of the two cars are connected to each other through the connecting wire or the connecting pipe mounted to the articulated truck. Thereby, wire connection or pipe connection between two cars is easily achieved. Since it is not necessary to recess car body ends to form spaces (concave portions) unlike in the conventional construction, an effective space within a passenger's cabin is not reduced, and an area of a passage can be increased.

In addition, since the connecting wire or the connecting pipe configured to connect the wires or the pipes of the cars is mounted to the truck frame of the articulated truck, the structure of the car body does not become intricate. Further, since the center of gravity of the car body is substantially as high as that of the train which is not equipped with the truck, running stability is improved and car performance is advantageously improved.

It is preferable that, the connecting wire or the connecting pipe has connecting members at both end portions, and the connecting members are removably connected to receiving members provided at end portions of the wires or the pipes of the cars.

In such a construction, merely by connecting the connecting members of the connecting wire or the connecting pipe of the articulated truck to the receiving members of the wires or the pipes of the cars or by disconnecting them from each other, electric connection and disconnection between the articulated truck and the cars for accomplishing wiring or piping between the cars are easily carried out.

Specifically, when electric wires (crossovers) or pipes are mounted in car body ends or on roofs thereof, it is difficult to carry out maintenance of cars including electric wiring or piping in a maintenance depot where inspection or repair is performed. However, in accordance with another aspect of the invention connection or disconnection between the connecting wire or the connecting pipe of the articulated truck and the wires or the pipes of the cars can be carried out under the floors of the cars. Consequently, maintenance of the cars is facilitated.

In accordance with another aspect of the invention the truck frame may be provided with a concave portion on an upper portion of a side frame thereof, and an intermediate portion of the connecting wire or the connecting pipe may be mounted within the concave portion.

In such a construction, the concave portion formed on the upper portion of the side frame of the truck frame of the articulated truck, which has been conventionally a dead space, can be utilized to store the connecting wire or the connecting pipe configured to connect the wires or the pipes of the cars to each other.

In particular, since the wires or the pipes of the front and rear cars are connected to each other by using the connecting wire or the connecting pipe mounted to the articulated truck mounted between the cars, it is not necessary to provide the protecting plate for protecting the crossovers (or pipes) provided between the coupling portions of the railway vehicle under the crossovers in order to inhibit damage to the crossovers, unlike in Japanese Utility Model Application Publication No. Hei. 6-37045.

In another aspect, it is preferable that a cover plate is configured to cover the concave portion formed on the upper portion of the side frame of the truck frame, and both end portions of the connecting wire or the connecting pipe penetrate through the cover plate and extend to outside of the concave portion.

In such a construction, a main portion other than the both end portions of the connecting wire or the connecting pipe configured to connect the wires or the pipes of the cars is stored in a space defined by the concave portion on the upper portion of the side frame and the cover plate and is not exposed to outside.

The connecting wire or the connecting pipe is not necessarily stored within the truck frame. In accordance with another aspect of the invention, the connecting wire or the connecting pipe is mounted to the outer side portion of the truck frame by using the mounting device.

In such a construction, since the connecting wire or the connecting pipe is mounted to the outer surface of the truck frame by using the mounting device, mounting the connecting wire or the connecting pipe becomes easy.

In that case, it is desirable to limit a degree of freedom (displacement) of the connecting wire or the connecting pipe. So, in accordance with another aspect of the invention, the mounting device may have a protecting pipe member mounted to extend along the outer side portion of the truck frame, and a fixing member configured to mount and fix the protecting pipe member to the outer side portion of the truck frame, wherein the connecting wire or the connecting pipe extends within the protecting pipe member. Or, in accordance with another aspect of the invention, the mounting device may have mounting members mounted to the connecting wire or the connecting pipe to be spaced a predetermined distance apart from each other, an attaching member attached to the truck frame or car bodies of the cars, and a flexible connecting member configured to connect the mounting members to the attaching member.

As defined herein, the term "flexible connecting member" means a connecting member configured to connect the mounting members of the connecting wire or the connecting pipe to the attaching member such that the connecting wire or the connecting pipe is not mechanically or fixedly connected but is displaceable within a certain range in order to inhibit the connecting wire or the connecting pipe from being disengaged from the truck frame or the car bodies of the cars, and includes chains, belt, and strings, etc.

BEST MODE FOR CARRYING OUT THE INVENTION

Hereinafter, embodiments of the present invention will be described with reference to the drawings.

EMBODIMENT 1

Figure 1:
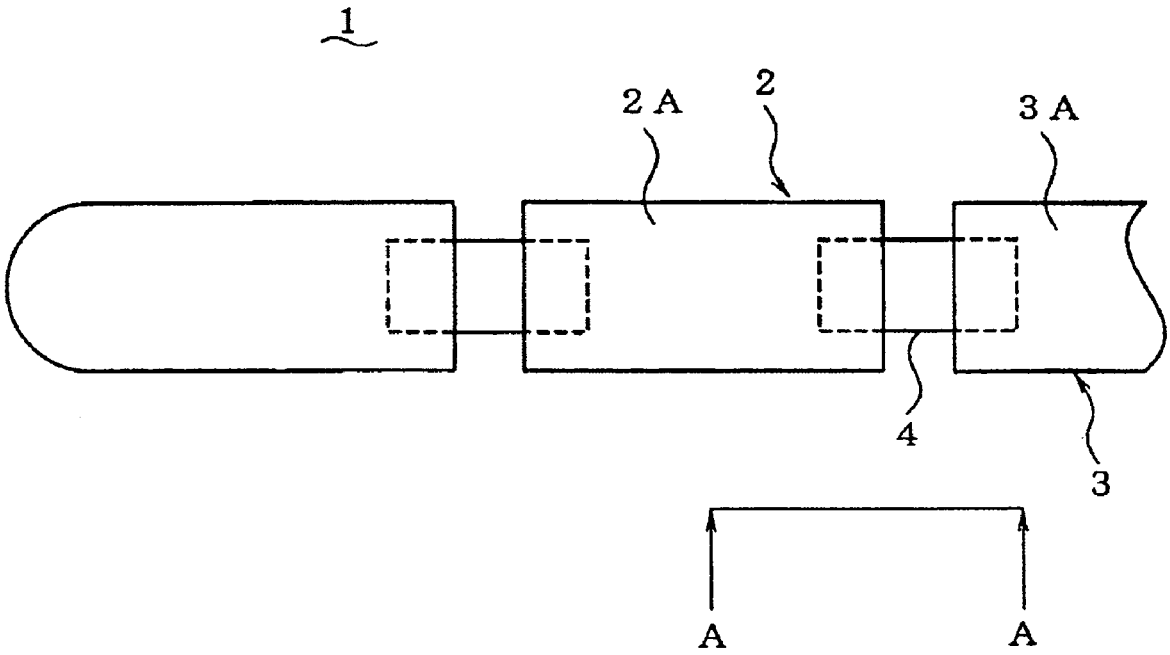
FIG. 1 is a view for explaining a train to which a wire structure of an articulated truck, according to an embodiment of a wire and pipe structure of an articulated truck of the present invention is applied.
Figure 2:
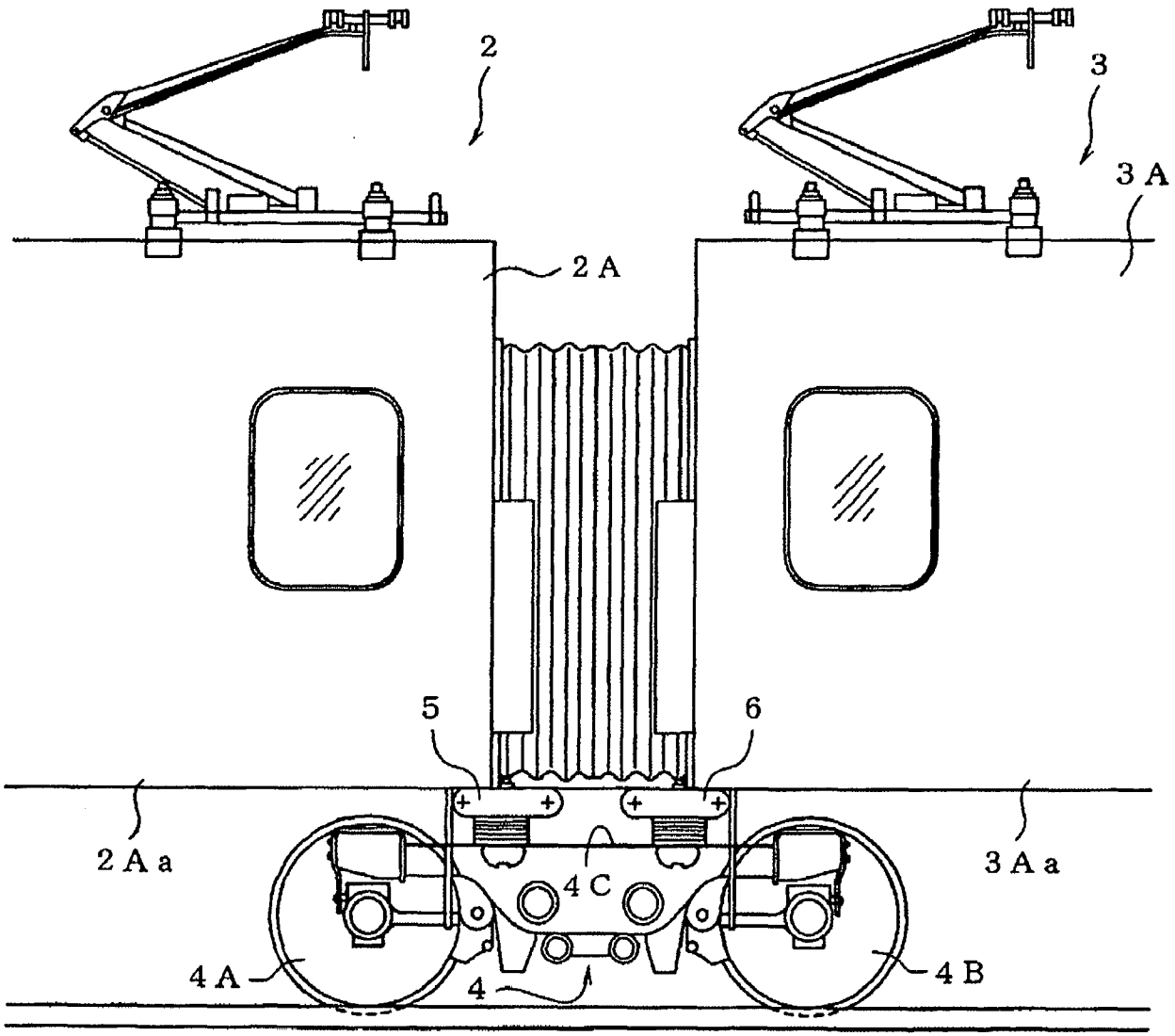
FIG. 2 is a cross-sectional view taken along line A-A in FIG. 1.

FIG. 1 is a view for explaining a train to which a wire structure of an articulated truck, according to an embodiment of a wire and pipe structure of an articulated truck of the present invention is applied. FIG. 2 is a cross-sectional view taken in the direction of arrows along line A-A in FIG. 1.

As shown in FIGS. 1 and 2, in a train 1 composed of a train set of a plurality of cars, an articulated truck (two axle articulated truck) 4 provided with front wheels 4A and rear wheels 4B is mounted, for example, between a second car 2 and a third car 3. The articulated truck 4 allows car bodies 2A and 3A of the front and rear cars 2 and 3 to be supported from below by air springs 5 and 6.

Figure 3:
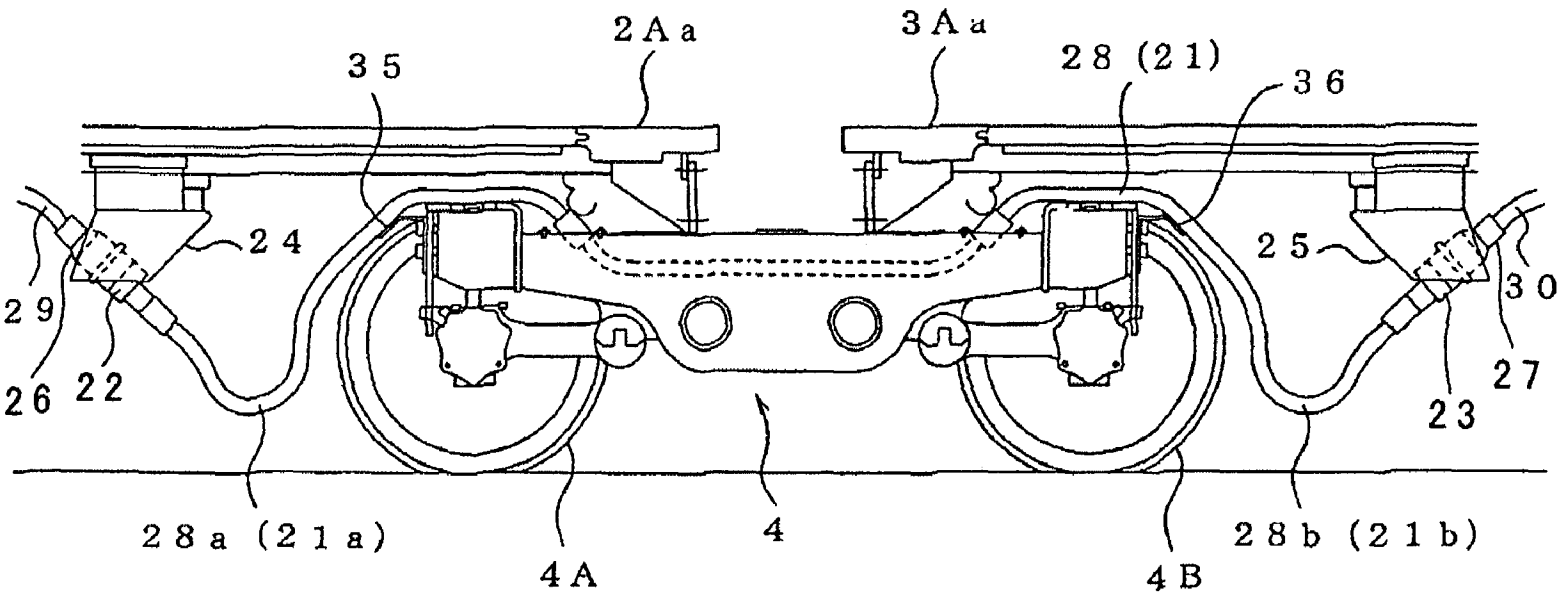
FIG. 3 is a schematic side view of the articulated truck of the present invention.
Figure 4A:
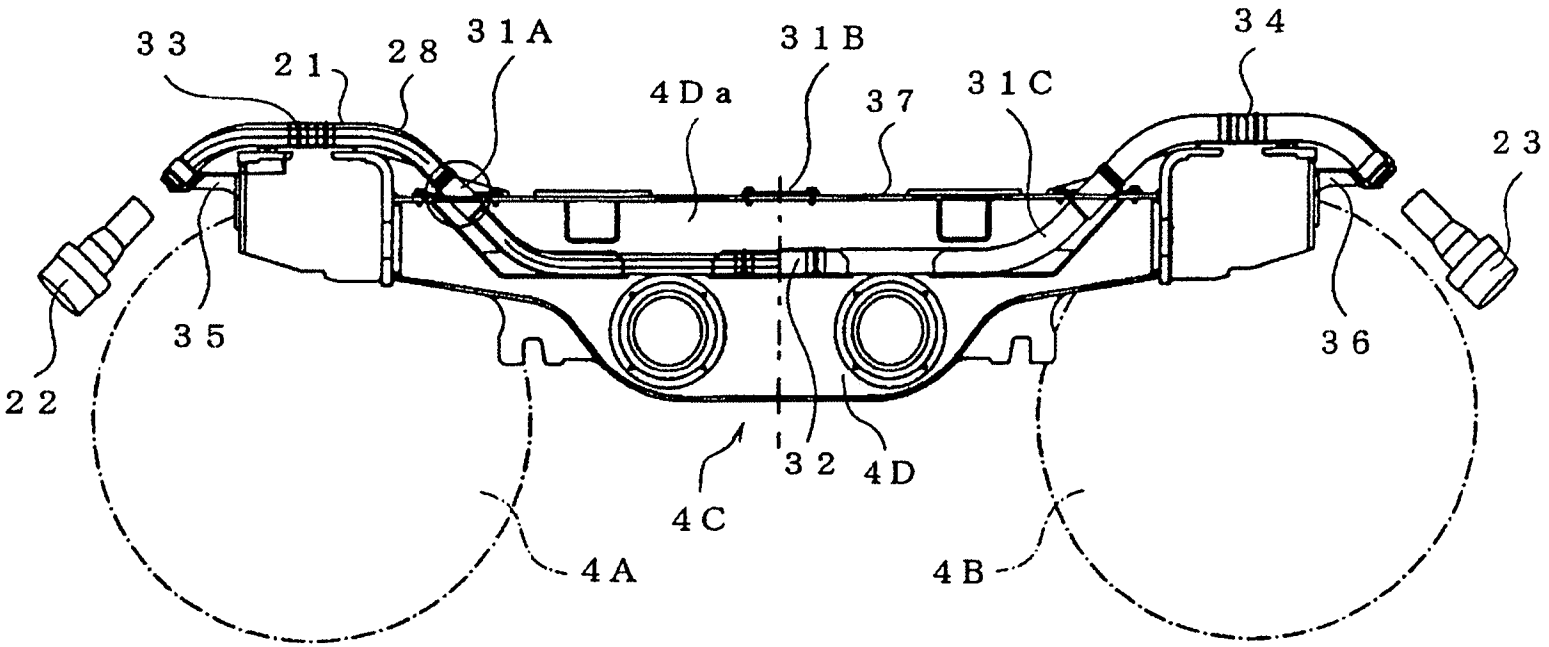
FIG. 4A is a side view of a side frame of a truck frame.
Figure 4B:
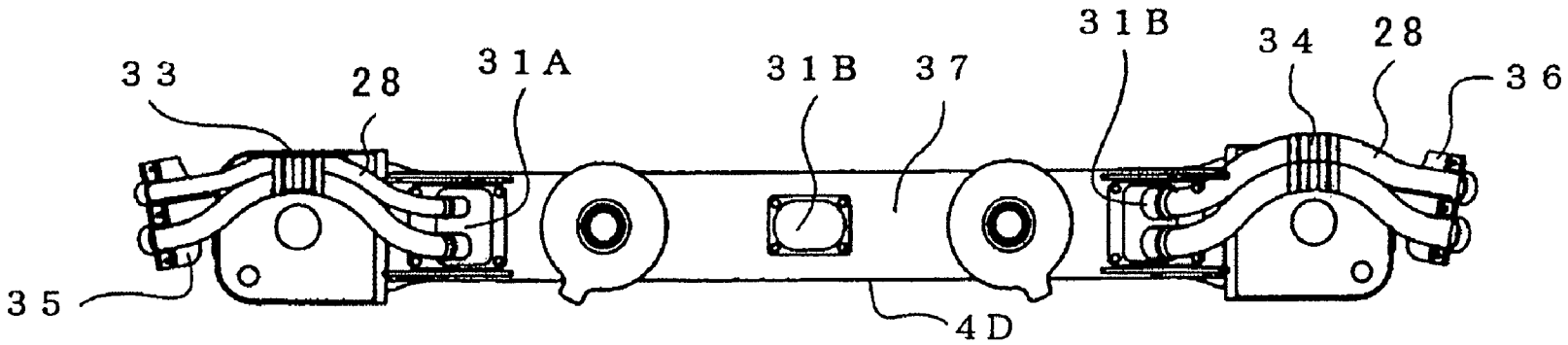
FIG. 4B is a plan view of the side frame of the truck frame.

And, wires (electric wires) disposed under the floors of car body frames 2Aa and 3Aa of the cars 2A and 3A are, as shown in FIGS. 3 and 4A and 4B interconnected through connecting wires 21 (corresponding to the conventional crossovers) mounted to truck frames 4C of the truck 4. The connecting wires 21 are inserted into flexible protecting pipe members 28, and are mounted to the truck frames 4C in such a manner that intermediate portions thereof are provided within concave portion 4Da (see FIG. 4A) which are trapezoid-shaped in cross section and formed on upper portions of right and left side frames 4D of the truck frame 4C. That is, the connecting wires 21 are entirely housed within the protecting pipe members 28.

The concave portions 4Da are closed such that their upper openings are covered with cover plates 37 which are thin-plate shaped. An intermediate portion of each protecting pipe member 28 (connecting wires 21) is mounted to extend along a bottom surface of the concave portion 4Da. Both end portions of the protecting pipe member 28 (connecting wires 21) penetrate through the cover plate 37 from an inside of the concave portion 4Da to an outside of the concave portion 4Da and further extend in the longitudinal direction of the truck 4 outside the concave portion 4Da to positions nearer the cars 2 and 3. Three lids 31A, 31B, and 31C are removably attached to the cover plate 37. The lids 31A and 31C serve to fix the protecting pipe member 28 (connecting wires 21) penetrating through the cover plate 37 to the cover plate 37. The protecting pipe member 28 is removably mounted and fixed to a portion of a bottom surface of the concave portion 3Da which corresponds to the lid 31B by means of a fixing member 32.

And, the protecting pipe members 28 (connecting wires 21) penetrating through the cover plate 37 are bundled by bundle members 33 and 34 and mounted to front and rear upper portions of the side frame 4D. The protecting pipe members 28 (connecting wires 21) are fixedly mounted to front and rear end portions of the side frame 4D by means of mounting brackets 35 and 36. Connectors (connecting members) 22 and 23 are provided at front and rear end portions of the protecting pipe member 28 (connecting wires 21) to electrically connect the connecting wires 21 stored in the protecting pipe member 28 to wires of the cars.

Mounting brackets 24 and 25 are mounted under the car body frames 2Aa and 3Aa of the cars 2A and 3A, respectively. The mounting brackets 24 and 25 serve to mount connectors (receiving members) 26 and 27 of wires 29 and 30 of the cars. The connectors 22 and 23 of the truck 4 are removably connected to the connectors (receiving members) 26 and 27 of the wires 29 and 30 of the cars, thus facilitating wire connection between the cars.

The protecting pipe member 28 (connecting wires 21) greatly sags down (sag portions 28*a* and 28*b* (21*a* and 21*b*)) in front of the wheel 4A and behind the wheel 4B and then are removably connected to the connectors 26 and 27 of the cars. The connectors 26 and 27 are low-voltage couplers when the wires (electric wires) 29 and 30 are low-voltage crossovers such as control lines or signal lines, and are high-voltage connectors when the wires 29 and 30 are high-voltage crossovers.

As should be appreciated, in this embodiment, the connecting wires 21 (crossovers) are stored within the concave portion 4Da which is an inner space within the side frame 4D of the truck frame 4C to connect the wires (electric wires) 29 and 30 of the front and rear cars 2 and 3 to each other, and the wires 29 and 30 of the first and second cars 2 and 3 are connected to each other through the connecting wires 21. Thus, the connecting wires 21 configured to connect the wires 29 and 30 of the cars can be easily disposed by efficiently utilizing a dead space within the truck frame 4C (concave portion 4Da of the side frame 4D).

When the connecting wires 21 mounted to the side frame 4D requires replacement, the connecting wires 21 can be easily replaced merely by detaching the three lids 31A, 31B, and 31C attached to the cover plate 37 and without detaching the cover plate 37.

Conventionally, in general, crossovers provided between coupled cars are configured to connect connecting portions provided at end portions of front and rear car bodies. The crossovers are made longer than an interval between the connecting portions to deal with movement of the cars associated with travel of the train, and are exposed and sag down on the rail side by their own weights. However, in this embodiment, since the inter-car wires (connecting wires) are provided within the side frame 4D of the truck frame 4C by utilizing the inner space of the truck frame 4C of the articulated truck 4, the inter-car wires (connecting wires) are not exposed. Therefore, unlike in Japanese Utility Model Application Publication No. Hei. 6-37045, it is not necessary to provide the protecting plate for protecting the crossovers provided between the coupling portions of the railway cars under the crossovers in order to inhibit damage to the crossovers.

While in the above described embodiment, the connecting wires 21 which function as the crossovers provided between the front and rear coupled cars are mounted within the concave portion 4Da of the side frame 4D of the truck frame 4C, they may alternatively be mounted to the outer surface of the truck frame 4C as will be described in a second embodiment.

EMBODIMENT 2

Figure 5A:
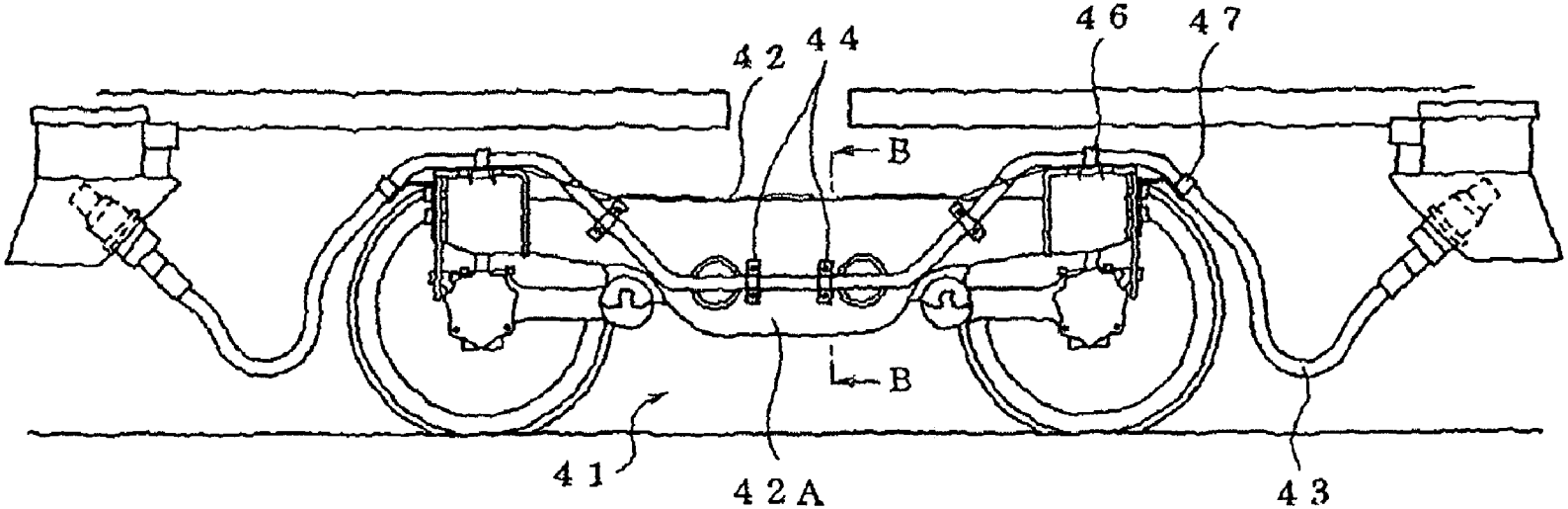
FIG. 5A is a side view of a construction in which a protecting pipe member (connecting wires) is directly fixed to the side frame according to a second embodiment of the present invention.
Figure 5B:
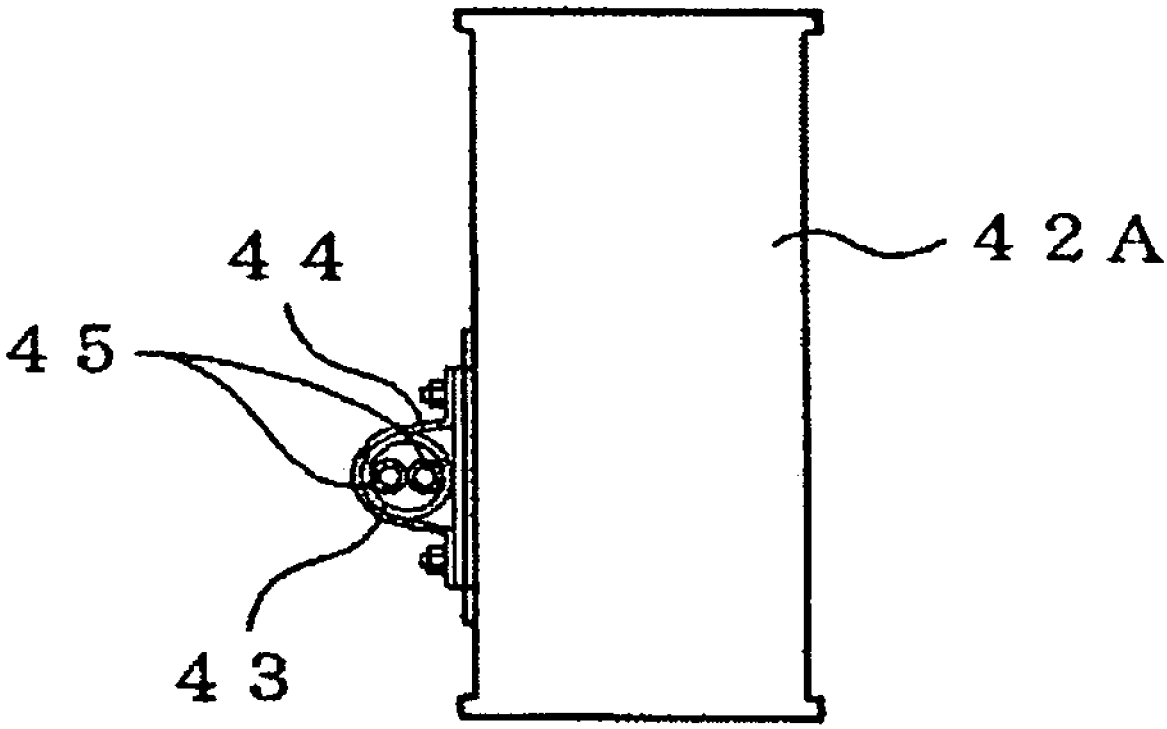
FIG. 5B is a cross-sectional view taken along line B-B in FIG. 5A.

FIG. 5A is a side view of a construction in which a protecting pipe member (connecting wires) is directly fixed to the side frame according to a second embodiment of the present invention. FIG. 5B is a cross-sectional view taken along line B-B in FIG. 5A.

As shown in FIGS. 5A and 5B, a flexible protecting pipe member 43, which is bent to sag down, is mounted and fixed to an outer surface of a side frame 42A forming a truck frame 42 of an articulated truck 41 by a plurality of mounting members 44. Connecting wires 45 are inserted into the protecting pipe member 43 to connect wires (feeder wires) under the floors of the front and rear cars to each other. Since the connecting wires 45 are inserted into the protecting pipe member 43, the connecting wires 45 and the protecting pipe member 43 are positioned. In other words, the protecting pipe member 43 allows the connecting wires 45 to be fixed to the truck frame 42. It will be appreciated that an inner diameter of the protecting member 43 may be suitably changed according to the diameter of the inserted wires (electric wires), the number of wires, etc, and the position at which the protecting pipe member 43 is mounted and fixed may be suitably changed as desired.

The protecting pipe member 43 (connecting wires 45) is mounted and fixed to the truck frame 42 (side frame 42A) at positions more distant from the articulated truck 41 by mounting members 46 and 47.

Figure 6A:
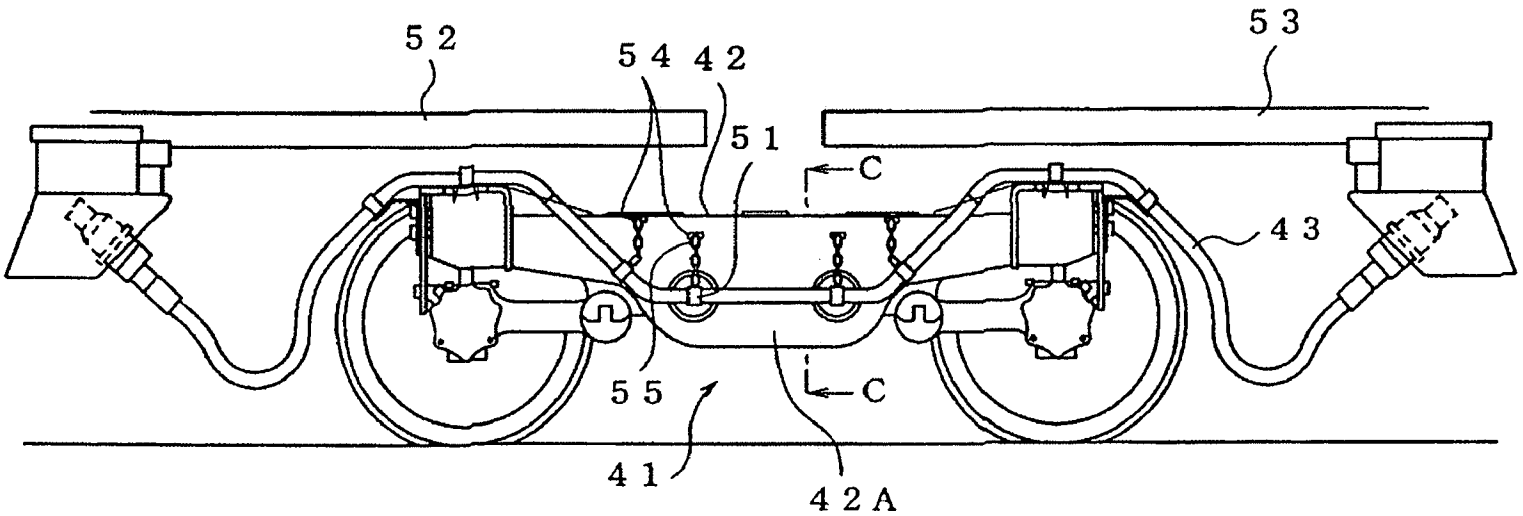
FIG. 6A is a side view of a construction in which the protecting pipe member (connecting wires) is displaceably mounted to the side frame.
Figure 6B:
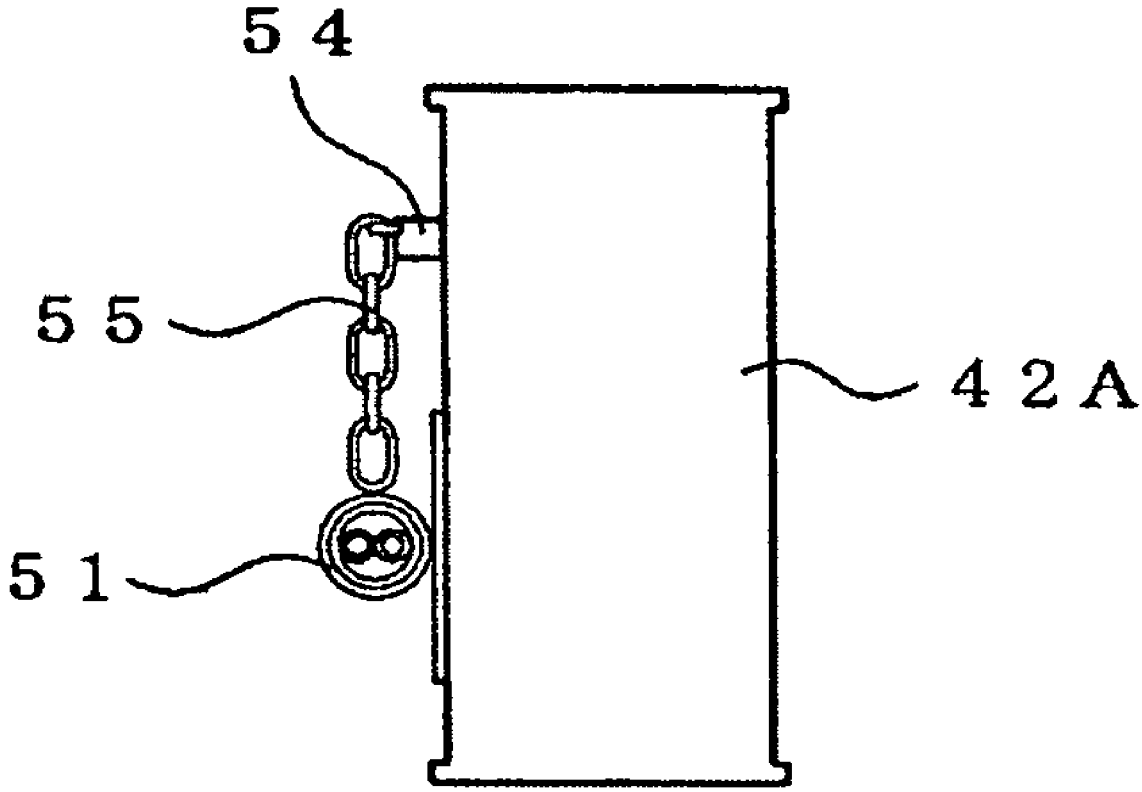
FIG. 6B is a cross-sectional view taken along line C-C in FIG. 9A.

When the protecting pipe member 43 (connecting wires 45) is mounted to an outer surface of the truck frame 42, it is not necessary to entirely fix the protecting pipe member 43. Instead, the protecting pipe member 43 may be mounted to be movable within a predetermined range as shown in FIGS. 6A and 6B.

Specifically, mounting rings 51 are mounted to the protecting pipe member 43 to be spaced apart a predetermined distance from each other in an axial direction of the protecting pipe member 43, and attaching members 54 are provided on the truck frame 42 or on the front and rear car bodies 52 and 53 so as to correspond to the mounting rings 51. And, the mounting rings 51 are connected to the attaching members 54 through connecting chains (flexible connecting members) 55. In this case, the mounting rings 51 are movable with respect to the attaching members 54 within a range, and within that range, mounting portions of the protecting pipe member 43 (mounting portions of the mounting rings 51) are displaceable.

The above described embodiments are intended not to be limiting of the present invention, which may be variously altered as described below.

Figure 7:
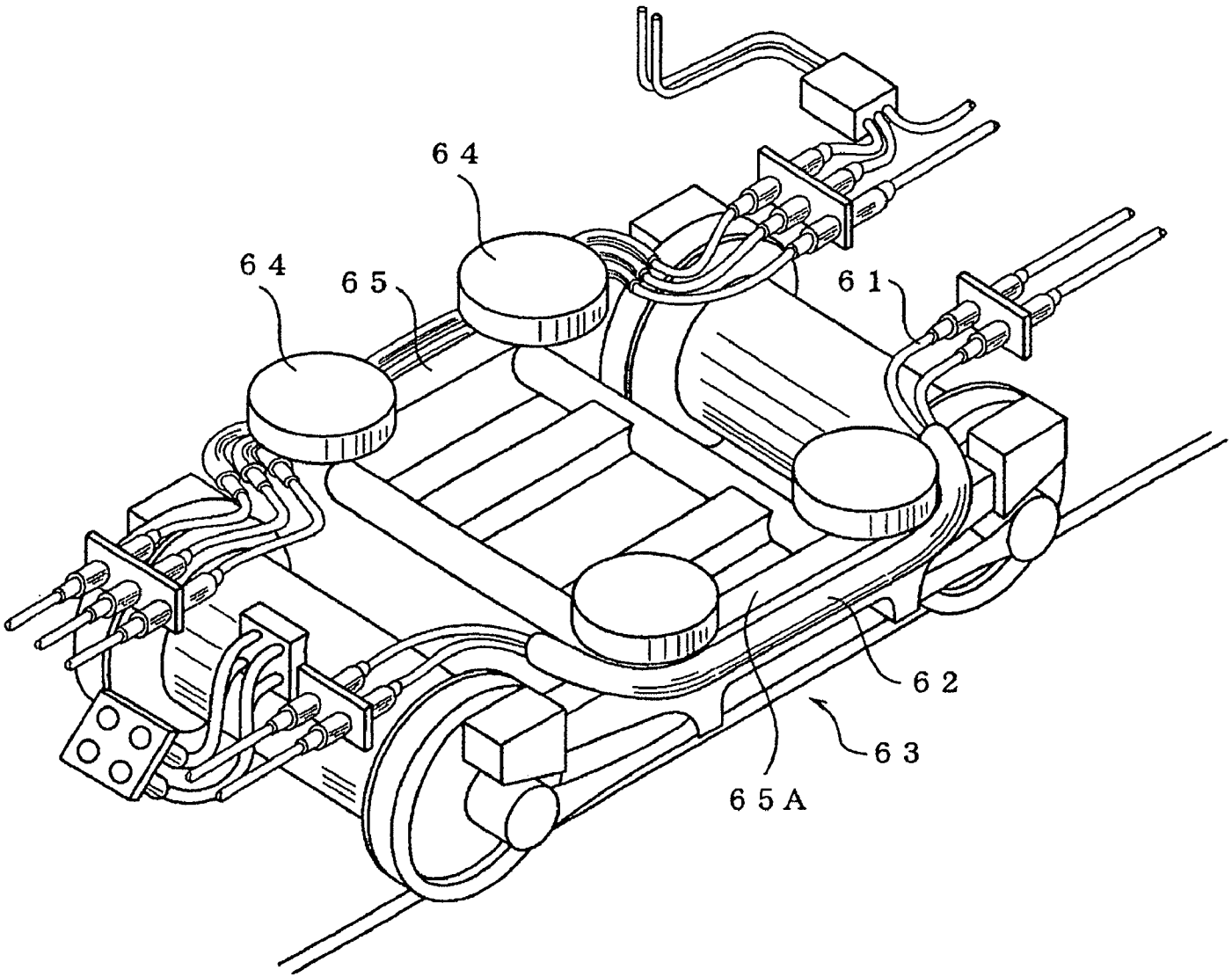
FIG. 7 is a perspective view showing a modification.
Figure 8:
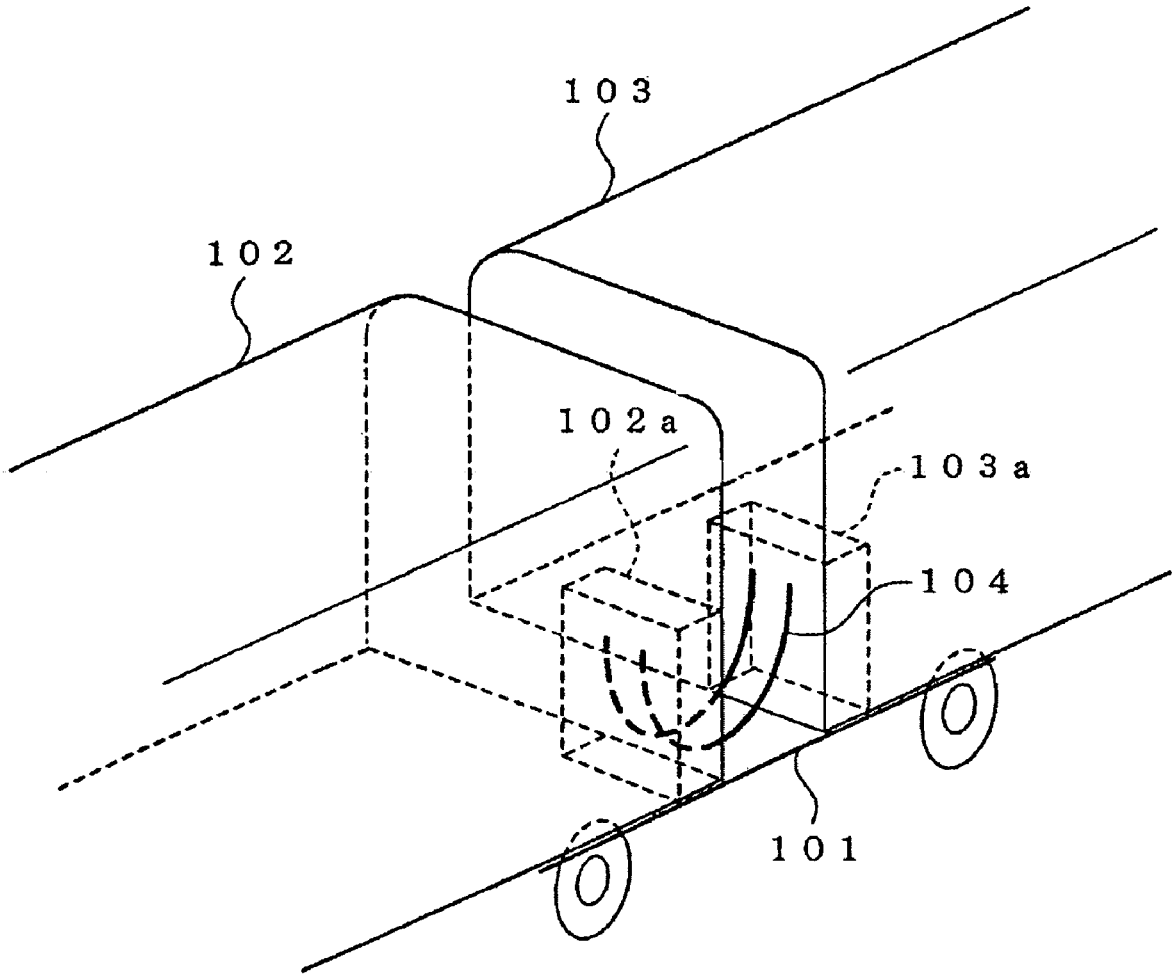
FIG. 8 is a view of a mounting structure of wires of the conventional articulated truck.

(1) In the above described embodiments, the connecting wires are fixed to the truck frame by using the mounting members, but this is only illustrative. For example, as shown in FIG. 7, the position of the protecting pipe for protecting the connecting wires may be restricted based on a positional relationship with components of an articulated truck (layout). In this case, protecting pipe members 62 into which the connecting wires 61 are inserted are made of synthetic resin having relatively high hardness, and fitted in upper portions of side frames 65A of truck frames 65 so as not to interfere with mounting portions of air springs 64 of the articulated truck 63. The wires on the right and left sides are main circuit straight pull wires and control circuit straight pull wires, respectively.

(2) While in the above described embodiments, the wires and the pipes are entirely protected by the protecting pipe member, the protecting pipe member for a part of or entire of these may be omitted.

(3) While in the above described embodiments, the connecting wires which function as the crossovers provided between the front and rear coupled cars have been described, the present invention is not intended to be limited to this. The present invention may be, of course, applicable to connecting pipes (e.g., pipes required for control by air) which are provided between front and rear cars and serve to connect pipes of the front and rear cars, or to both of the connecting wires and the connecting pipes. In that case, both of the wires and the pipes may be, of course, mounted within or outside of the truck frame. In addition, for example, the connecting wires may be mounted within the truck frame and the connecting pipe may be mounted to an outer surface of the truck frame. Or, the connecting pipe may be mounted within the truck frame and the connecting wires may be mounted to the outer surface of the truck frame.

INDUSTRIAL APPLICABILITY

The present invention is practiced as described above. Since the wires and the pipes disposed under the floor of car body frames are connected to each other through the connecting wires or the connecting pipe mounted to the truck frame of the articulated truck, wiring and piping become easy and maintenance of the articulated truck is facilitated.

In particular, the connecting wires or the connecting pipes may be each structured to have connecting members at both ends portions and receiving members provided at end portions of the wires or the pipes of the cars are connected to the connecting members. Thereby, merely by connecting the connecting members of the truck to the receiving members of the cars or disconnecting them from each other, connection and disconnection of the wires and the pipes between the articulated truck and the cars can be easily accomplished.

The invention claimed is:

1. An articulated truck mounted between two cars, comprising:

a connecting wire or a connecting pipe configured to interconnect wires or pipes of two cars which are disposed under floors of the two cars; and a truck frame of the articulated truck, wherein the truck frame is provided with a concave portion on an upper portion of a side frame thereof, and an intermediate portion of the connecting wire or the connecting pipe is mounted within the concave portion.

2. The articulated truck according to claim 1, wherein the connecting wire or the connecting pipe has connecting members at both end portions, and the connecting members are removably connected to receiving members provided at end portions of the wires or the pipes of the cars.

3. The articulated truck according to claim 1, further comprising:

a cover plate configured to cover the connecting wire or the connecting pipe within the concave portion, wherein both end portions of the connecting wire or the connecting pipe penetrate through the cover plate and extend to outside of the concave portion.

4. The articulated truck according to claim 1, wherein the concave portion is trapezoid-shaped in cross section.

* * * * *